United States Patent [19]

Sanai

[11] Patent Number: 4,722,280

[45] Date of Patent: Feb. 2, 1988

[54] MOLDED LOW DENSITY CONTROLLED PRESSURE SOLID EXPLOSIVE MATERIAL AND METHOD OF MAKING SAME

[75] Inventor: Mohsen Sanai, Palo Alto, Calif.

[73] Assignee: SRI International, Menlo Park, Calif.

[21] Appl. No.: 932,657

[22] Filed: Nov. 19, 1986

[51] Int. Cl.[4] ..... C06D 5/06

[52] U.S. Cl. ..... 102/289; 149/93; 149/109.6; 264/3.1; 264/3.3

[58] Field of Search ..... 264/3.1, 3.2, 3.3; 102/288, 289; 149/93, 109.6

[56] References Cited

U.S. PATENT DOCUMENTS

| | | | |
|---|---|---|---|
| 1,758,358 | 5/1930 | Ennis | 102/288 X |
| 2,768,072 | 10/1956 | Stark | 52/5 |
| 2,845,025 | 7/1958 | Stark | 102/10 |
| 3,014,427 | 12/1961 | Scurlock | 102/288 X |
| 3,049,454 | 8/1962 | Stark | 149/92 |
| 3,198,677 | 8/1965 | Thomas | 149/19 |
| 3,224,191 | 12/1965 | Bratton | 102/288 X |
| 3,308,210 | 3/1967 | Ross | 264/3.1 |
| 3,756,025 | 9/1973 | McCullough | 102/289 X |
| 3,812,785 | 5/1974 | Cohen et al. | 149/93 X |
| 4,013,743 | 3/1977 | Blasche, Jr. et al. | 102/289 X |
| 4,039,640 | 8/1977 | Leneveu | 149/92 X |
| 4,151,022 | 4/1979 | Donaghue et al. | 149/19.4 |
| 4,343,663 | 8/1982 | Breza et al. | 149/93 X |
| 4,408,534 | 10/1983 | Araki et al. | 102/288 |
| 4,466,352 | 8/1984 | Dalet et al. | 102/288 |

*Primary Examiner*—Peter A. Nelson
*Attorney, Agent, or Firm*—John P. Taylor

[57] ABSTRACT

A molded explosive member having mating means molded along the periphery to permit interlocking of adjacent members is disclosed. The molded member from an explosive material comprising a mixture of from 30 to 70 wt. % pentaerythritol tetranitrate (PETN) powder, about 1 wt. % graphite, and 70 to 30 wt. % foamable polystyrene beads heated in a closed mold, in the absence of moisture in contact with the PETN powder, graphite, and polystyrene beads, to a temperature of from about 90° to 104° C. to foam the polystyrene beads and mold the explosive material into the desired shape. The amount of PETN powder in the mixture is varied to adjust the desired amount of pressure generated during detonation of the molded explosive member.

15 Claims, 20 Drawing Figures

FIG. 12
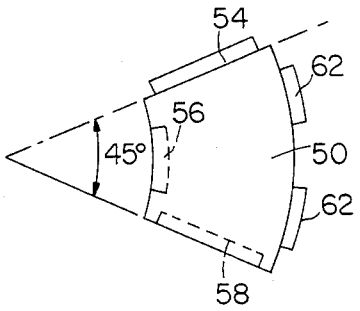
FIG. 11
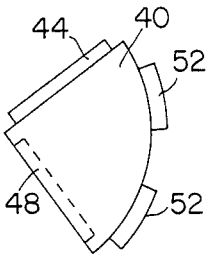
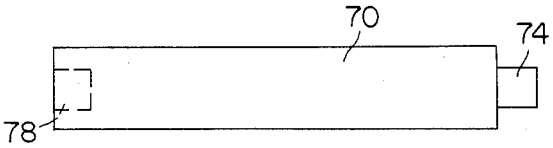
FIG. 13
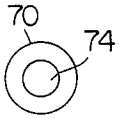
FIG. 14
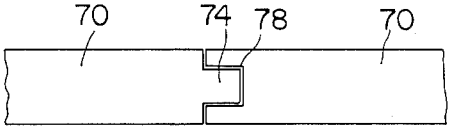
FIG. 15
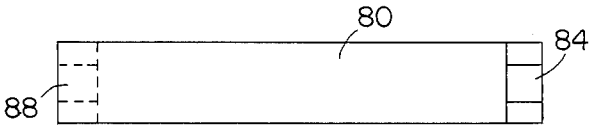
FIG. 16
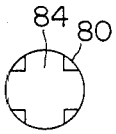
FIG. 17
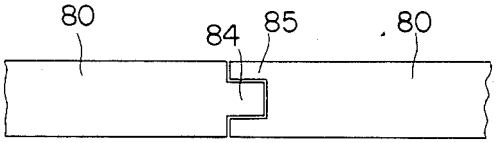
FIG. 18

MOLDED LOW DENSITY CONTROLLED PRESSURE SOLID EXPLOSIVE MATERIAL AND METHOD OF MAKING SAME

BACKGROUND OF THE INVENTION

The invention described herein was made in the course of work under contract to the Department of Defense.

1. Field of the Invention

This invention relates to solid explosives. More particularly, this invention relates to a molded low density explosive member of controllable pressure which has been molded into a shaped object having interlocking peripheral means using, as main ingredients, pentaerythritol tetranitrate (PETN) powder and expandable foam polystyrene beads and a method of making same.

2. Description of the Related Art

It is desirable to form a solid explosive material into a predetermined shape to achieve control of the direction of the pressure wave propagated upon detonation of the explosive. It is also desirable to control the amount of pressure generated during detonation. Conventionally, this is done by preselecting a particular explosive material or composition which develops pressure in the desired range. It is also desirable to provide a lightweight explosive material.

Stark in U.S. Pat. Nos. 2,768,072; 2,845,025; and 3,049,454 describes a shaped lightweight explosive having a cellular foam structure. The molded material is formed by dissolving the explosive in a solvent, such as styrene, which is then mixed with a cross-linkable unsaturated polyester together with the proper catalysts and accelerators to promote cross-linking. The mixture is then foamed as it sets up either by introducing compressed air through the mixture or by incorporating into the mixture a chemical blowing agent, such as diazoaminobenzene or toluene diisocyanate.

While the foregoing provides a way of forming a molded explosive material, the use of cross-linkable unsaturated polyester resins is both expensive and time-consuming; and the amount of usable explosive is limited to the amount which will dissolve in the solvent. Furthermore, pentaerythritol tetranitrate (PETN) explosive powder is not compatible with liquid resins due to chemical reaction therebetween which presents unacceptable safety risks.

Thomas U.S. Pat. No. 3,198,677 describes the incorporation of an explosive into a foamed polyurethane structure by dispersing the explosive into the monomers before curing of the polyurethane. However, polyurethane foams are usually open cell type foams which permit penetration of moisture which, in turn, will desensitize some solid explosives such as, for example, pentaerythritol tetranitrate (PETN) powder.

Donaghue et al U.S. Pat. No. 4,151,022 also discloses formation of an explosive composition by mixing together an explosive and components capable of forming a foam. The patentees state that the nature of the explosive component is not narrowly critical, and that while the compositions may include high explosives such as trinitrotoluene, pentaerythritol cyclotrimethylenetrinitramine, and the like, they are not essential ingredients and when present, say in the role of sensitizing agents, the proportion thereof in the composition should be a comparatively minor one.

When the resin materials are liquid, the patentees state that the explosive is conveniently mixed with one of the liquid components prior to forming the foam. When the resin materials are solid, the patentees say that the materials are usually converted to a liquid or pasty form prior to blending with the explosive component. Thus, in the instance of a matrix of polystyrene, a matrix is said to be prepared by heating polystyrene particles—admixed with an explosive component—in the presence of a blowing agent and allowing the blowing agent to penetrate the particles.

Araki et al U.S. Pat. No. 4,408,534 disclose a molded explosive in the shape of a sheet or disk with raised projections to contact adjoining sheets or disks formed into a stack. The raised projections keep adjoining sheets or disks from face to face contact with one another.

It would, however, be desirable to mold a dry mixture of an explosive powder, such as pentaerythritol tetranitrate (PETN) powder, and foamable polystyrene beads having a puffing agent previously incorporated therein in a heated mold into a desired foamed shape without exposure to water or any externally added blowing agent during the molding process.

Moreover, it would be desirable to be able to mold such a mixture into shapes having mating means which permit interlocking of adjoining molded explosive members to permit smooth propagation of the pressure wave.

SUMMARY OF THE INVENTION

It is therefore an object of this invention to form a dry molded low density foam explosive member from a dry powder mixture of foamable polystyrene beads and an explosive powder.

It is another object of this invention to form a dry molded low density foam explosive member of predetermined shape from a dry mixture of pentaerythritol tetranitrate (PETN) powder and a mixture of polystyrene beads having a puffing agent previously incorporated into at least some of the beads to render them foamable.

It is a further object of the invention to provide shaped low density foam explosive member comprising pentaerythritol tetranitrate (PETN) powder and foamed polystyrene and having mating means comprising molded projections and recessions molded therein to permit adjoining molded pieces to be interlocked together to promote propagation of the pressure wave during subsequent detonation.

It is yet a further object of the invention to provide a method for forming such shaped explosive products.

These and other objects of the invention will become apparent from the following description and accompanying drawings.

In accordance with the invention, a shaped explosive member having mating means molded along the periphery thereof to permit interlocking of adjacent members is formed from an explosive material comprising a mixture of from 30 to 70 wt. % pentaerythritol tetranitrate (PETN) powder, about 1 wt. % graphite powder, and 70 to 30 wt. % foamable polystyrene beads heated in a closed mold in the absence of moisture in contact with the PETN and polystyrene to a temperature of from 90° to 100° to foam the polystyrene beads and mold the material into the desired shape.

BRIEF DESCRIPTION OF THE DRAWINGS

FIG. 11 is a top view of another embodiment of the invention used in forming circular charges.

FIG. 12 is a top view of yet another embodiment of the invention useful in forming circular charges of larger diameter.

FIG. 13 is a top view of another embodiment comprising the explosive material of the invention in the shape of an interlocking rod or stick.

FIG. 14 is is an end view of the embodiment shown in FIG. 13.

FIG. 15 is a fragmentary side section view of two interlocking rods or sticks formed in accordance with the embodiment of FIGS. 13 and 14.

FIG. 16 is a top view of another embodiment comprising the explosive material of the invention in the shape of an interlocking rod or stick having a different interlocking shape.

FIG. 17 is is an end view of the embodiment shown in FIG. 16.

FIG. 18 is a fragmentary side section view of two interlocking rods or sticks formed in accordance with the embodiment of FIGS. 16 and 17.

DETAILED DESCRIPTION OF THE INVENTION

Figure 1:
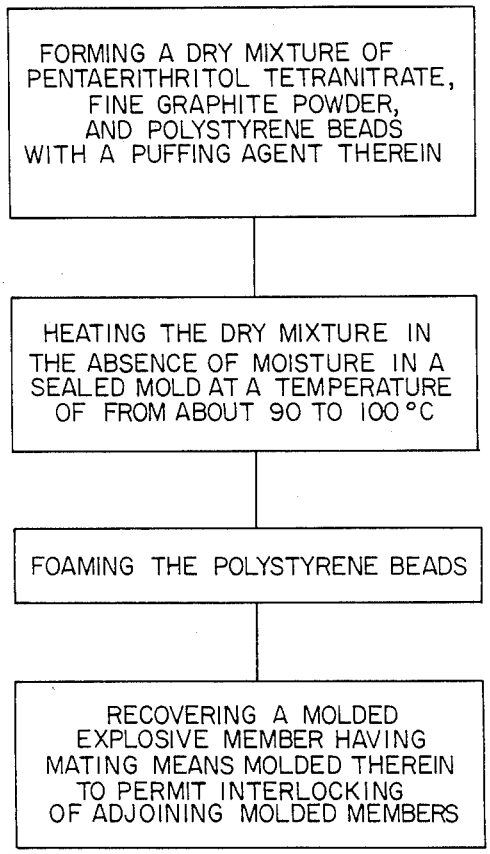
FIG. 1 is a flowsheet illustrating the process of the invention.

The invention comprises a low density dry molded foam explosive member which may be formed with a predetermined explosive pressure determined by the amount of explosive incorporated into a dry mixture of explosive powder and foamable polystyrene beads.

The dry explosive powder used in the production of the dry molded explosive material of the invention preferably comprises pentaerythritol tetranitrate (PETN) powder since this is one of the few explosives readily available commercially in powder form. The PETN explosive powder has an average particle size range of approximately 0.025 to 0.076 millimeters (1–3 mils).

The amount of PETN powder used per total weight of PETN powder and polystyrene beads may vary from 30 to 70 wt. %. If less than 30 wt. % of PETN powder is used, the explosive mixture will not detonate properly while the use of over 70 wt. % PETN powder will result in a material which will not properly bind together due to the insufficient amount of polystyrene beads present.

The actual amount of PETN powder used in the dry mixture, however, will depend upon the desired amount of pressure to be developed during the detonation. For example, when 30 wt. % PETN powder is used the pressure developed will be approximately 1 kilobar while a 50–50 mixture will develop 7 kilobars of pressure and a mixture containing 70 wt. % PETN powder will result in 70 kilobars of pressure. Thus, the explosive material of the invention is pressure adjustable over a wide range of pressures.

The foamable polystyrene beads useful in forming the dry molded explosive material of the invention comprises generally spherical foamable polystyrene beads having a particle size range of from about 0.10 to 0.40 millimeters (4–16 mils) in diameter, preferably about 0.25 millimeters (10 mils). The foamable beads contain an alkane puffing or blowing agent such as butane or pentane. Such expandable polystyrene beads are commercially available under the trademark Dylite D1965B from Arco Chemical Company in Philadelphia, Pennsylvania.

In accordance with the invention, while the beads are referred to herein as "foamable polystyrene beads", some of the beads may be prepuffed, i.e., partially expanded, prior to the molding operation, to a diameter of from about 0.5 to 1.25 millimeters (20–50 mils) which comprises from about 25 to 75 volume % of the final expansion of the bead. The advantage of having some of the beads already partially puffed is to control the density of the resulting explosive mixture since the density will affect the fixed pressure which develops after detonation. The use of such prepuffed beads also provides some control of the volume expansion and therefore the pressure developed in the closed mold during the foaming and molding operation. While the amount of prepuffed beads may range from 0 to 100 wt. % of the polystyrene beads used, preferably the amount ranges from about 30 to 70 wt. % and most preferably from about 40 to 60 wt. %. Typically, about 50 wt. % of the beads used will be prepuffed.

The remainder of the beads comprise either unpuffed beads or unexpandable beads sometimes referred to as "dead" beads due to the lack of a puffing agent therein. The presence of the "dead" beads, assists in controlling the accuracy of the molding resulting in, for example, sharper corners when at least some dead beads are used. Up to about 30 wt. % of the total amount of polystyrene beads used may be dead beads, preferably 10 to 20 wt. %, with 20 wt. % a typical amount. If greater amounts of "dead" beads are used, however, an insufficient amount of pressure may be generated in the mold to result in proper binding of the softened foamed polystyrene particles to bind together. Thus, the mixture of polystyrene beads will be referred to herein as "foamable polystyrene beads" despite the presence of some "dead" beads.

The amount of unexpanded foamable beads in the bead mixture may range from 0 to 100 wt. %, but preferably ranges from about 10 to 50 wt. % and most preferably from about 20 to 40 wt. % with 30 wt. % typically used.

The dry mixture of pentaerythritol tetranitrate (PETN) powder and foamable polystyrene beads is mixed with approximately 1 wt. % graphite powder having an average particle size of about 1–5 microns to make the mixture semiconductive so that hazardous static electricity does not build up during the mixing process. The mixture of dry powders is placed in a conventional, tumbling-type, explosion-proof mixer and mixed for about one half hour.

The dry powder mixture is then placed in a waterproof aluminum mold of the desired shape and heated to a temperature of from about 90° to 104° C., preferably about 95° to 100° C., in an explosion-proof oven for about one to four hours to permit the beads to foam and expand. The temperature range is important because a temperature which is too low will not permit properly softening and foaming of the beads while subjecting the explosive to a temperature of over 104° C. is inadvisable and, at any rate, can require the need to take special and costly precautions under applicable safety laws for the handling of explosives.

It has been found that immersing the waterproof mold in boiling water at standard pressure will result in a convenient and inexpensive way of exposing the PETN-polystyrene mixture to the correct temperature range for foaming of the polystyrene beads.

To provide for uniform temperature distribution throughout the mold, hollow tubes or pipes may be inserted through the mold via sealable openings in the mold walls. Hot water may then be passed through the hollow pipes to convey the heat more efficiently to the interior of the mold. When such pipes are used, they are advantageously removed while the polystyrene is still hot (but after removal of the mold from the water since exposure of the dry mixture to water, in either liquid or vapor form, may desensitize the explosive) to thus permit some of the foamed polystyrene to still flow to seal up the openings left in the molded block of explosive material by the presence of the pipes.

After the mold has cooled to room temperature, the foamed molded explosive material is removed from the mold as a rigid closed cell material. To waterproof the exterior of the shaped explosive material and to prevent the shake off of loose PETN particles, the molded product may be sprayed with an inert plastic such as, for example, a Verathane Clear Gloss spray available from the Flecto Company in Oakland, California.

In accordance with the invention, in addition to controlling the amount of pressure generated by the explosive material by varying the ratio of PETN explosive to polystyrene, the explosive material, molded in accordance with the invention, may be formed into desired shapes and thicknesses to respectively control the propagation of the pressure wave and the duration.

Figure 2:
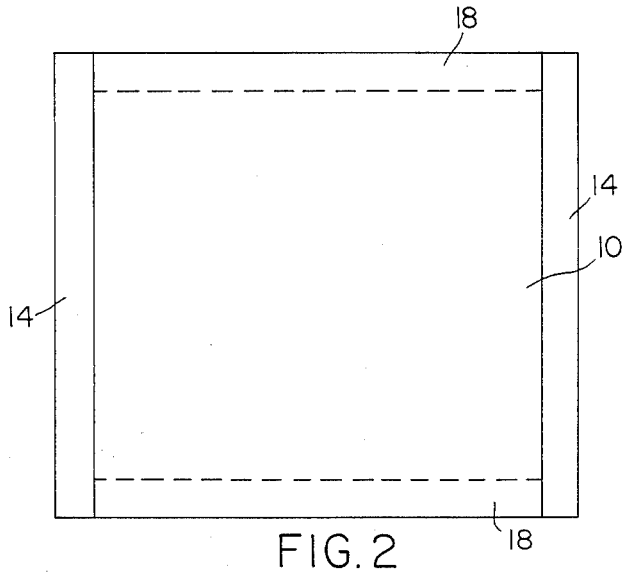
FIG. 2 is a top view of one embodiment of the invention showing a rectangular plate or tile formed using the explosive material of the invention.
Figure 3:
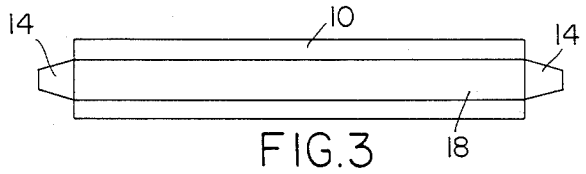
FIG. 3 is a side section view of the tile shown in FIG. 2.
Figure 4:
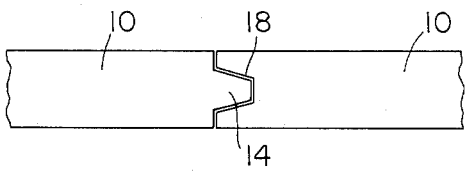
FIG. 4 is a fragmentary side section view of the interlocking of two adjacent tile members constructed in accordance with the embodiment of FIGS. 2 and 3.

Referring now to FIGS. 2–4, the molded explosive mixture of PETN and foamed polystyrene is illustrated as formed into a rectangular tile 10 having tab portions 14 formed on two opposed edges and grooves 18 formed in the other two opposed edges. Tab portions 14 and grooves 18 form tongue and groove mating means between adjacent tiles when a plurality of such tiles are laid down in a pattern over a desired area for detonation.

The function of the interlocking tongue and groove mating means between the tiles is to permit smooth transfer of the explosion from one tile to the next without jumping of the explosion between adjacent tiles which would result in generation of undesirable pressure wave forms. If desired, special tiles having either one or two adjacent smooth side edges may be formed for use, respectively, along end edges and corners of the interlocking pattern of tiles laid out over the area to be detonated.

Rectangular tiles 10, which may, for example, be formed as 12 inch squares of varying thicknesses depending upon the desired duration of the pressure wave, can be used to generate ground shock waves useful in packing fill dirt or the like to a predetermined density. The tiles may also be used in the simulation of other explosions, such as nuclear explosions, for research purposes.

Tiles 10 may be formed to a thickness varying, for example, from 2 to 12 inches depending upon the desired duration of the pressure wave. Typically, tiles 10 will be formed with a thickness of about 2 to 6 inches.

Figure 5:
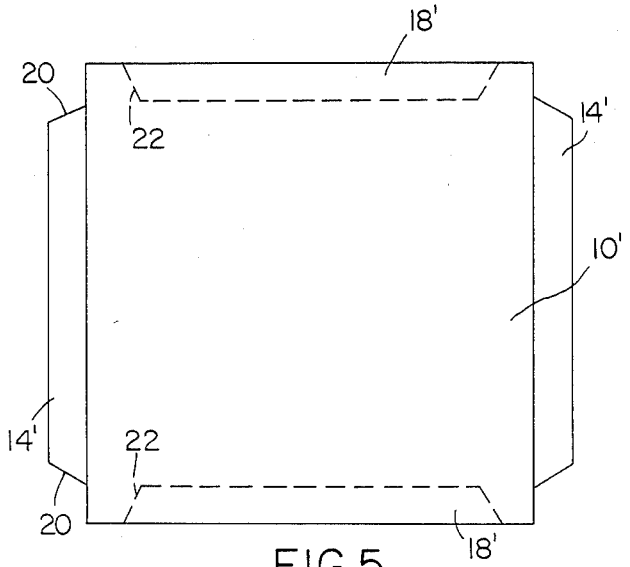
FIG. 5 is a top view of another embodiment of the invention showing another shape of rectangular plate or tile formed using the explosive material of the invention.
Figure 6:
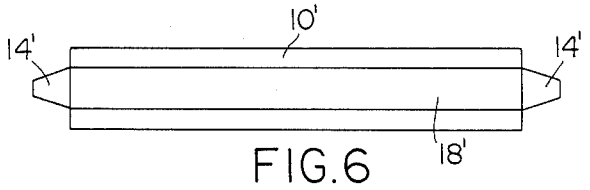
FIG. 6 is a side section view of the tile shown in FIG. 5.
Figure 7:
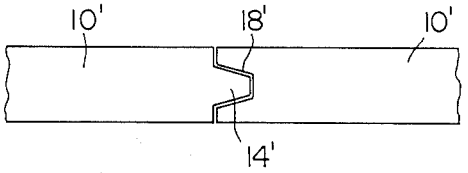
FIG. 7 is a fragmentary side section view of the interlocking of two adjacent tile members constructed in accordance with the embodiment of FIGS. 5 and 6.

FIGS. 5–7 illustrate a variation of the interlocking tongue and groove mating means between adjoining tiles 10' wherein the tongues 14' and the grooves 18' do not extend to the corners of tiles 10' but rather have tapered side edges 20 on tongues 14' and mating tapers 22 on grooves 18' adjacent the corners of the tiles. The reason for this variation is that the tongues are stronger structurally and better survive the subsequent placement and handling of the tiles.

Figure 8:
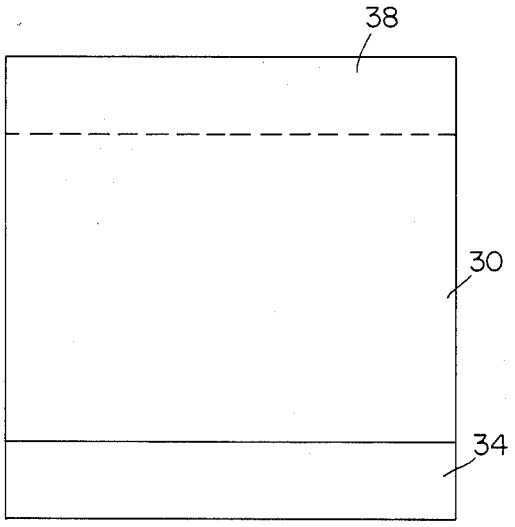
FIG. 8 is a top view of another embodiment of the invention showing another rectangular plate or tile formed using the explosive material of the invention.
Figure 9:
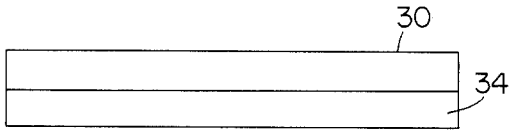
FIG. 9 is a side section view of the tile shown in FIG. 8.
Figure 10:
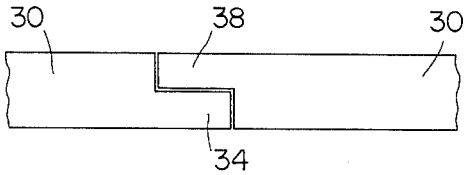
FIG. 10 is a fragmentary side section view of the interlocking of two adjacent tile members constructed in accordance with the embodiment of FIGS. 8 and 9.

Turning to FIGS. 8–10, yet another variation of the square tile molded from the explosive material of the invention is illustrated which is particularly useful when it is desired to propagate the pressure wave in a single direction. In this embodiment, tile 30 is formed having a cutaway or routed portion of the surface forming a stepped projection of approximately half the thickness of the tile along one edge of the tile creating a tab 34 of half the thickness of the tile and a corresponding cutaway or routed portion on the opposite surface of the tile on an opposite edge leaving a corresponding tab 38. This permits the tiles 30 to be laid end to end along one axis with the tabs 34 and 38 fitting into the corresponding cutaway portion of the adjacent tile as shown in FIG. 10.

FIG. 11 shows another embodiment wherein tile 40 has been molded into a 90° circular segment comprising a tab 44 on one edge of the segment and a mating groove 48 on the other edge to permit four such segments to form an interlocking circle when a circular pattern of detonation is desired. Tile 40 is further shown with tabs 52 formed on the arc of the segment to permit an addition pattern or circle of 45° segments, such as tile 50 shown in FIG. 12, to be placed in another row around tiles 40 to form a circle of larger diameter.

Tiles 50 are also formed with interlocking tabs 54 and grooves 58 to permit interlocking of eight similarly shaped tiles to form the larger circle. Tiles 50, however, are further formed with a groove 56 along the inner arc of the tile which will mate with tab 52 of tile 40 to permit interlocking of the tiles 40 in the inner row or circle with tiles 50 in the outer row to again permit smooth transfer of the explosion and resulting pressure wave from tile to tile in the circular pattern. Tiles 50 may be formed with tabs 62 along the outer arc of the tile to permit interlocking with yet another row of 22.5° tiles if yet a larger diameter pattern is desired.

The explosive material of the invention may also be molded into interlocking sticks to be placed in bore holes of similar diameters for subsequent detonation. This usage of the control of the amount of pressure generated by the explosive material of the invention, due to variation of the amount of PETN explosive powder in the mixture, may be particularly useful here in the control of the fracture of solids, for example in gem mining.

FIGS. 13–15 illustrate such interlocking molded sticks or rods 70 formed with a central circular button or protuberance 74 of reduced diameter on one end and a central bore 78 of matching diameter on the opposite end so that the rods may be interlocked together in a bore hole in the material to be detonated as shown in FIG. 15.

FIGS. 16–18 illustrate a variation on the embodiment of FIGS. 13–15 wherein the button or protuberance 84 on rod 80 is shown in FIG. 17 to have a cross or plus shape in cross-section which, in turn matches the molded opening 88 formed in the opposite end of rod 80.

Figure 19:
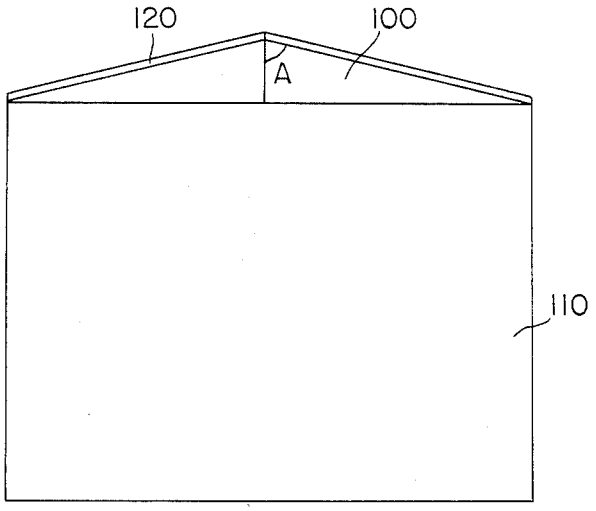
FIG. 19 is a side view of a conically-topped low density explosive embodiment.
Figure 20:
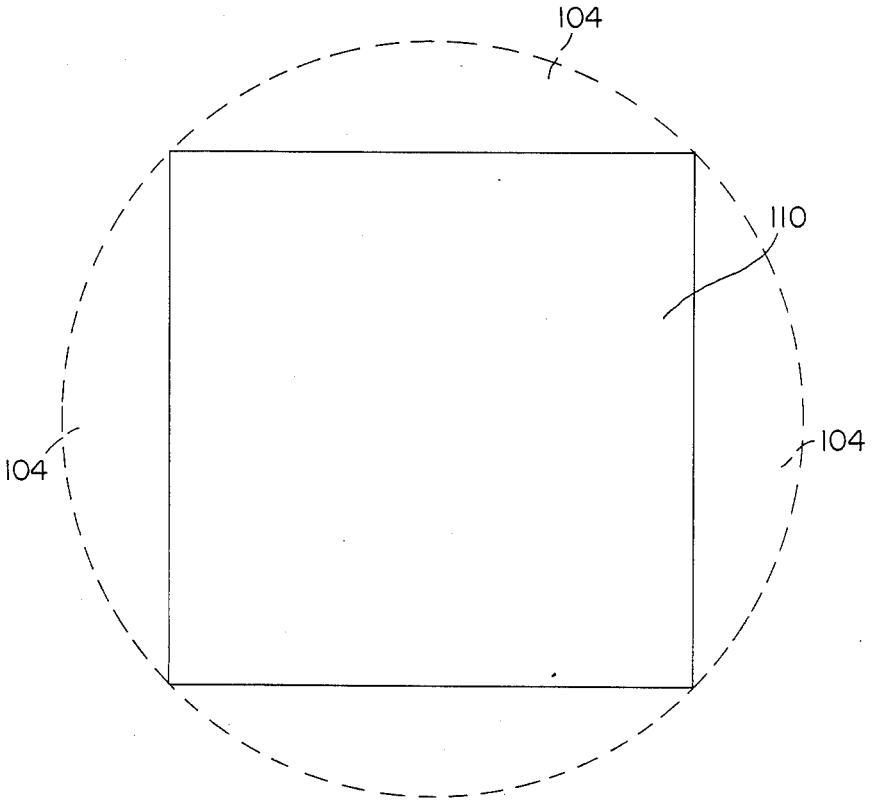
FIG. 20 is a top view of the embodiment shown in FIG. 19.

Turning to FIGS. 19 and 20, yet another embodiment of the invention is illustrated wherein a low pressure planar detonation may be achieved. In this embodiment a generally conical shaped low density explosive member 100 is molded in accordance with the invention and then placed over a rectangular tile 110 of low density explosive material having a diagonal of the same length as the diameter of conical member 100. Both conical member 100 and tile 110 are molded in accordance with the invention using dry mixtures of PETN, graphite, and foamable polystyrene beads although the density of the two forms may vary if desired.

As best seen in FIG. 20, the overlapping portions 104 of conical member 100 are trimmed away to provide a match to the top profile of tile 110. Sheets 120 of detasheet C plastic explosive having a high rate of detonation are then placed over the conical surface of conical explosive member 100. This plastic sheet explosive material is usually commercially available in 40 mil sheet thickness and from 2 to 4 layers of such sheets are used to provide sufficient detonation which has been determined to require at least 80 mil thickness of detasheet C.

The angle A which conical member 100 defines with the vertical is predetermined to provide for propagation of the detonation from the center of the cone vertically downward at a speed equal to the sum of the propagation of the detonation along the detasheet explosive 120 on the surface of conical member 100 and then downwardly through the less thick portions of conical member 10 spaced from the apex so that all portions of the upper surface of explosive tile 110 beneath conical member 100 are detonated at the same time to provide for the desired planar detonation of tile 110. It has been found that when conical member 100 is molded with an angle A of about 72°–75°, that a planar detonation of tile 110 can be achieved.

Thus, the invention provides for the adjustment of explosive pressure by adjustment of the amount of PETN explosive powder in the original mixture to provide a variation in pressure from as small as 1 kilobar to as high as 70 kilobars to thereby permit formulation of explosive materials having lower pressures than conventional explosives which can be advantageous in mining and excavating due to the production of larger fracture debris.

Furthermore, the distribution of explosive density of the PETN explosive powder is permanent and the explosive PETN powder does not settle or shake off during transportation or handling thereby increasing both safety and convenience in handling and transportation of the molded product and the molded explosive material is protected by the polystyrene against desensitization by moisture resulting in longer shelf life.

Finally, the molded tiles provide a void-free explosive blanket for impulse loading of flat surfaces of rectangular or circular area while the molded rods or sticks provide uniform internal loading when placed in drill holes. The thickness cf the tiles can be used to control the duration of the pressure wave, while the interlocking tabs and grooves insure smooth propagation of the pressure wave along the entire desired area of detonation demarcated by the area covered by the tiles.

Having thus described the invention, what is claimed is:

1. A method of dry molding a molded explosive member having mating means molded along the periphery to permit interlocking of adjacent members which comprises:

(a) forming a dry explosive mixture comprising:
  (1) from 30 to 70 wt. % pentaerythritol tetranitrate (PETN) powder having a particle size range of from about 0.025 millimeters to 0.075 millimeters;
  (2) about 1 wt. % graphite; and
  (3) 70 to 30 wt. % foamable polystyrene beads having a particle size range of from about 0.10 to 1.25 millimeters comprising a mixture of about 30 wt. % expandable beads having a puffing agent previously incorporated therein but which have not been already prepuffed, about 50 wt. % prepuffed beads having a puffing agent previously incorporated therein, and about 20 wt. % of unexpandable beads; and (b) heating said dry mixture in a sealed mold, in the absence of moisture in contact with said PETN powder, graphite, and polystyrene beads, at a temperature of from about 95° to 100° C. by immersing said sealed mold in water boiling at standard pressure to foam said polystyrene beads and mold the explosive material into the desired shape.

2. A molded explosive member having mating means molded along the periphery to permit interlocking of adjacent members and formed from an explosive material comprising a mixture of from 30 to 70 wt. % pentaerythritol tetranitrate (PETN) powder and 70 to 30 wt. % foamable polystyrene beads having a puffing agent previously incorporated therein and heated, in a closed mold in the absence of moisture in contact with the PETN powder and polystyrene beads, to a temperature of from about 90° to 104° C. to foam the polystyrene beads and mold the explosive material into a flat rectangular tile with mating means comprising projections formed on two opposite edges of the tile and two grooves formed on edges of said tile adjacent said edges having projections formed therein, said projections and grooves having similar cross-sectional dimensions to permit formation of interlocking tongue and grooves between adjacent tiles to permit smooth transfer of the explosion from one molded explosive member to adjoining tile members interlocked therewith.

3. A molded explosive member having mating means molded along the periphery to permit interlocking of adjacent members and formed from an explosive material comprising a mixture of from 30 to 70 wt. % pentaerythritol tetranitrate (PETN) powder and 70 to 30 wt. % foamable polylstyrene beads having a puffing agent previously incorporated therein and heated, in a closed mold in the absence of moisture in contact with the PETN powder and polystyrene beads, to a temperature of from about 90° to 104° C. to foam the polylstyrene beads and mold the explosive material into a flat rectangular tile 30 having mating means comprising stepped projections 34 and 38 formed in the opposite surfaces on two opposite end edges of tile 30, said stepped projections having similar cross-sectional dimensions to permit formation of interlocking mating means between adjacent tiles along one axis to permit smooth transfer of the explosion from one molded explosive tile member 30 to adjoining tile members interlocked therewith along a single axis.

4. A molded explosive member having mating means molded along the periphery to permit interlocking of adjacent members and formed from an explosive material comprising a mixture of from 30 to 70 wt. % pentaerythritol tetranitrate (PETN) powder and 70 to 30 wt. % foamable polystyrene beads having a puffing agent previously incorporated therein and heated, in a closed mold in the absence of moisture in contact with the PETN powder and polystyrene beads, to a temperature of from about 90° to 104° C. to foam the polystyrene beads and mold the explosive material into a flat tile defining a circular segment and said mating means respectively comprise one or more projections and grooves formed on the two opposite side edges of the circular tile segment, said projections and said grooves having similar crosssectional dimensions to permit formation of interlocking tongue and grooves between adjacent circular tiles segments and one or more projections or grooves respectively along the inner and outer car defined by the segment to provide interlocking mating means to join together adjacent rows of circular tile segments to provide a larger circular area of detonation with smooth transfer of the explosion from one molded explosive member to adjoining tile members interlocked therewith.

5. A molded explosive member formed from an explosive material comprising a mixture of from 30 to 70 wt. % pentaerythritol tentranitrate (PETN) powder and 70 to 30 wt. % foamable polystyrene beads having a puffing agent previously incorporated therein and heated, in a closed mold in the absence of moisture in contact with the PETN powder and polystyrene beads, to a temperature of from about 90° to 104° to C. foam the polystyrene beads and mold the explosive material into a generally conical tile having an apex angle to the vertical of about 72°–75° and said conical surfaces are covered with at least 80 mils of a conventional sheet explosive to produce a planar low pressure wave at the base of said member when the apex is detonated.

6. A method of dry molding a molded explosive member having mating means molded along the periphery to permit interlocking of adjacent members which comprises:

(a) forming a dry explosive mixture comprising from 30 to 70 wt. % pentaerythritol tetranitrate (PETN) powder and 70 to 30 wt. % foamable polystyrene beads having a puffing agent previously incorporated therein; and (b) heating said dry mixture in a sealed mold, in the absence of moisture in contact with the PETN powder and polystyrene beads, to a temperature of from about 90° to 104° C. by:

(1) immersing said sealed mold into water boiling at standard pressure;

(2) sealingly inserting a plurality of hollow rods through the walls of said sealed mold;

(3) circulating boiling water through said hollow rods to heat the interior of said mold more evenly; and (4) removing said rods while said molded explosive mixture in said mold is still hot;

to thereby foam the polystyrene beads and mold the explosive material into the desired shape.

7. The molded explosive member of claim 2 wherein said projections and said mating grooves are formed with at least two tapered edges.

8. The molded explosive member of claim 4 wherein each of said circular tile segments comprise a 90° segment.

9. The molded explosive member of claim 4 wherein each of said circular tile segments comprise a circular segment defining an arc of less than 90°.

10. The molded explosive member of claim 9 wherein each of said circular tile segments comprise a 45° segment.

11. The method of claim 6 wherein said forming step comprises mixing said PETN powder with a foamable polystyrene bead mixture which comprises:

(a) from 0 to 100 wt. % expandable beads which have not been already prepuffed.

(b) from 0 to 100 wt. % prepuffed beads; and (c) from 0 to 20 wt. % of unexpandable beads.

12. The process of claim 11 wherein said foamable polystyrene bead mixture comprises:

(a) from 20 to 40 wt. % expandable beads which have not been already prepuffed.

(b) from 40 to 60 wt. % prepuffed beads; and (c) from 10 to 20 wt. % of unexpandable beads.

13. The process of claim 12 wherein said foamable polystyrene bead mixture comprises:

(a) about 30 wt. % expandable beads which have not been already prepuffed;

(b) about 50 wt. % prepuffed beads; and (c) about 20 wt. % of unexpandable beads.

14. The process of claim 6 wherein said step of forming said dry mixture of PETN powder and foamable polystyrene beads further comprises using PETN powder having a particle size range of from about 0.025 millimeters to 0.075 millimeters and foamable polystyrene particles having a particle size range of from about 0.10 to 1.25 millimeters.

15. The process of claim 6 wherein said step of heating said dry mixture is carried out at a temperature range of from about 95° to about 100° C.

* * * * *